United States Patent [19]

Ishioka

[11] Patent Number: 5,020,216

[45] Date of Patent: Jun. 4, 1991

[54] APPARATUS FOR LOADING CABLE ON CONNECTOR

[75] Inventor: Hideyuki Ishioka, Tokyo, Japan

[73] Assignee: Hirose Electric Co., Ltd., Tokyo, Japan

[21] Appl. No.: 515,630

[22] Filed: Apr. 27, 1990

[30] Foreign Application Priority Data

May 30, 1989 [JP] Japan ..... 1-134764

[51] Int. Cl.[5] ..... H01N 43/04

[52] U.S. Cl. ..... 29/753; 29/759

[58] Field of Search ..... 29/753, 751, 759, 714–718, 29/748

[56] References Cited

U.S. PATENT DOCUMENTS 4,470,181 9/1984 Sergeant ..... 29/748 X 4,888,864 12/1989 Masaki ..... 29/753

*Primary Examiner*—Carl E. Hall

*Attorney, Agent, or Firm*—Kanesaka & Takeuchi

[57] ABSTRACT

A machine for loading a plurality of conductors of a multiconductor cable on a plurality of contacts or retaining channels of a connector, includes a housing having a plurality of openings on a side of the housing and a plurality of movable units, each movable through each of the openings between two positions; a preparation position where a cable is set on the movable unit and a loading position where respective conductors of the cable are loaded on the connector. Each movable unit includes a base; a connector holder provided on a top of the base to hold the connector; a cable holder provided adjacent the connector holder for holding the multiconductor cable; a conductor receiver provided adjacent the connector holder for receiving the conductors aligned one upon another in a vertical plane parallel to the connector holder; and a conductor carrier movable over the movable unit to carry a conductor from the receiver to each of the contacts or retaining channels for connection.

4 Claims, 3 Drawing Sheets

APPARATUS FOR LOADING CABLE ON CONNECTOR

BACKGROUND OF THE INVENTION

1. Field of the Invention

The present invention relates generally to machines for loading a cable on a connector and, more particularly, to a machine for loading individual conductors of a cable on corresponding retaining channels of a connector for connection by pressure.

2. Description of the Prior Art

Japanese Patent Application Kokai No. 57-182,988 discloses a machine of this type. The machine includes a pair of longitudinal rollers spaced apart at the distance of a conductor diameter between which a number of conductors are aligned side by side; a ram for pushing the conductors out of the rollers one by one; and a disc with a notch provided at the lower ends of the longitudinal rollers so that one conductor is moved for each rotation of the disc.

A pair of lateral rollers are provided below the longitudinal rollers to hold a conductor between them applying tension to it. A transfer arm with a V-shaped notch is provided so as to reciprocate through a arcked slot provided on the disc. A connector is placed at a position adjacent the front of the transfer arm and is moved by pitch, with a multiconductor cable held in the vicinity.

In the above machine, when the notch of the disc corresponds to the lower ends of the rollers, one conductor is received in the notch and moved by a half circle by rotation of the disc. The front end of the conductor is then held between the lateral rollers and pulled downwardly for stretching in the diametrical direction of the disc. When the transfer arm is advanced through the arcked slot of the disc, the V-shaped notch brings the conductor to the desired position. The conductor is then inserted into the desired retention groove of the connector by an insertion device which is provided beside the connector. In response to the conductor identification signal, the connector is moved so that the desired retention groove is positioned below the insertion device.

In the above machine, however, the conductor is transferred to the lateral rollers from the disc by making use of the hanging end portion of the conductor. Consequently, when the conductor has a short hanging portion or bent portion, the lateral rollers can fail to catch it, which in turn causes the transfer arm to fail to bring the conductor to the desired position. In addition, even when the lateral rollers catch the hanging portion, the transfer arm can fail to bring the conductor to the desired position.

Since the multiconductor cable is held along the longitudinal direction of the connector, it is impossible to position the cable at the center of the connector but either end of the connector, requiring a special connector case.

In addition, during the connection by pressure of a cable in the above machine, it impossible to prepare the next multicore cable for connection, resulting in the low efficiency. Also, the movable part is exposed, thus presenting a safety problem.

SUMMARY OF THE INVENTION

Accordingly, it is an object of the present invention to provide an apparatus for loading a cable on a connector which is reliable and efficient in operation.

According to the invention there is provided a apparatus for mounting a plurality of conductors of a multiconductor cable on a plurality of contacts of or a plurality of retaining channels of a connector, which includes a connector holder for holding the connector such that the contacts or retaining channels are exposed; a cable holder provided adjacent the connector holder for holding the multiconductor cable; a receiver unit provided adjacent the connector holder, the receiver unit having a receiver slit extending downwardly from a top surface of the receiver unit and having a width substantially equal to a conductor diameter for receiving the conductors aligned side by side in a vertical plane parallel to the connector holder, and a biasing plate provided at a bottom of the receiver slit for biasing upwardly the aligned conductors; a transfer unit provided on the receiver unit for reciprocating movement in a direction perpendicular to the vertical plane and having a transfer groove extending parallel to the vertical plane for moving a single top conductor in the receiving slit; a receiving groove provided on the top surface extending parallel to the vertical plane for receiving a conductor when the transfer unit is moved to an advanced position; an escapement slot extending in a direction perpendicular to the vertical plane and downwardly from the top surface by a distance greater than the conductor diameter; two pairs of fingers which enter the escapement slot to hold the conductor therebetween when the transfer plate is advanced, one of the fingers cutting the insulator of the conductor into contact with the core wire; a carrier unit with a frame rotatable about a shaft parallel to the vertical plane and movable in each direction of a rectangular coordinate system and having an arm for changing the distance between the two pairs of fingers; a pusher unit provided on the carrier unit adjacent one of the finger pairs and movable along the shaft to push the conductor into the contact or retaining channel of the connector; a plurality of movable units on which the cable retainer, cable receiver, transfer plate, and receiving means are mounted as a unit so that they reciprocate through the opening of the housing; and a control unit in response to the conductor number signal to move the fingers so that the conductor is placed above a desired contact or retaining channel and inserted thereinto by the pusher unit to thereby mount the conductor on the connector.

According to the invention, a multiconductor cable is loaded on a connector as follows.

(1) One of the units is drawn from the housing through the opening, and desired lengths of individual conductors of a multiconductor cable are separated, and the multiconductor cable is held in place by the cable holder. The individual conductors are then placed in the receiver slit one upon another. The top conductor is covered by the transfer plate so that jumping out of the conductor is prevented.

(2) The unit is retreated into the housing, and the biasing plate pushes up the conductors so that the top conductor is pressed against the transfer plate. When the transfer plate is advanced, the conductor is transferred into the receiving groove.

(3) Two pairs of carrier fingers are lowered into the escapement slots to hold the conductor therebetween.

(4) The blade of one of the fingers cuts the insulator of the conductor into contact with the core wire to identify the conductor number. In response to the identification signal, the conductor carrier is brought to the desired retaining channel of a connector.

(5) While the conductor carrier is brought to the desired position, the two pairs of fingers are separated further to stretch the conductor.

(6) When the carrier fingers bring the conductor to the desired retaining channel or contacts, the conductor is inserted into the retaining channel or contacts by the insertion device. The above steps are repeated to mount all the conductors on the connector.

(7) While the unit is performing the above steps (2)-(6), another unit is drawn from the housing to start the step (1) and then the steps (2)-(6).

Other objects, features, and advantages of the invention will be apparent from the following description when taken in conjunction with the accompanying drawings.

DESCRIPTION OF THE PREFERRED EMBODIMENT

Figure 1:
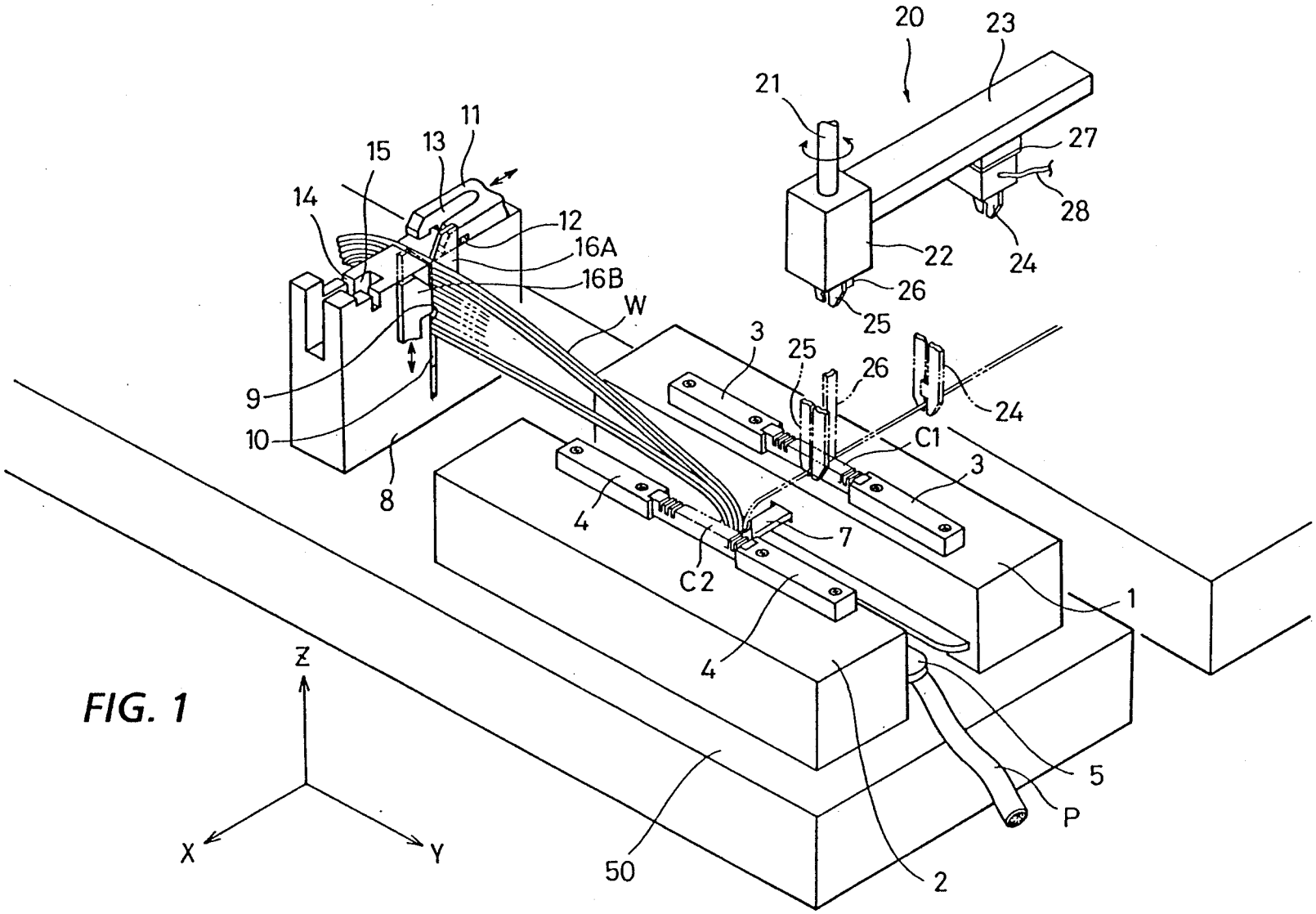
FIG. 1 is a perspective view of the essential part of a machine for loading a cable on a connector according to an embodiment of the invention.

FIG. 1 shows a machine for loading a cable on a connector according to an embodiment of the present invention. A rectangular coordinate system XYZ is given to help clarification of directions. This machine includes a pair of base sections 1 and 2 mounted on a movable base 50, which is movable along the Y axis, and spaced apart along the X axis. A pair of connector holders 3 or 4 are provided on the top edge portion of each base section 1 or 2 along the Y axis so that an elongated connector is positioned along the Y axis. These connector holders 3 or 4 are movable along the Y axis and interchangeable with other types according to the size and type of a connector. A guide plate 5 with a U-shaped recess for guiding a multiconductor cable P is provided between the base sections 1 and 2. A cable holder 7 is provided so as to be movable in the X direction and holds by pressure the cable P when it is positioned at the bottom of the U-shaped recess.

A receiver block 8 is mounted on the movable base 50 behind the base sections 1, 2 and has a receiver slit 9 extending downwardly from the top surface of the receiver block 8 in a Y-Z plane. The widths of the slit 9 in the X direction is made substantially equal to the diameter of a conductor. The conductor herein used means an insulated wire. A biasing plate 10 is provided at the bottom of the slit and biased upwardly in the Z direction by a compression spring or the like (not shown).

A transfer plate 11 is provided on the right side of the slit 9 for slidinq movement on the top surface of the receiver block 8. This transfer plate has on the sliding surface a transfer groove 12 extending in the Y direction so as to receive a conductor and a U-shaped recess 13.

A receiving groove 14 is provided on the top of the receiver block 8 on the left side of the slit 9 for receiving a conductor. It is positioned such that when the transfer plate 11 is advanced, the transfer groove 12 registers with the receiving groove 14. An escapement slot 15 extends downwardly from the top of the receiver block 8 in a Z-X plane so that it intersects the receiving groove 14. The depth of the escapement slot 15 is made greater than that of the receiving groove 14. The receiving groove 14 and the escapement slot 15 constitute a conductor receiving unit.

A pair of guide plates 16A and 16B are provided on opposite sides of the receiving slit 9 on the receiver block 8. The upper inner corners of the guide plates 16A and 16B are cut in the form of a V-shape to make it easy to put conductors into the receiving slit 9. The guide plate 16A is fixed so that its top end portion always projects from the top of the receiver block 8 while the guide plate 16B is movable such that its top end portion is lowered below the top of the receiver block 8. That is, the guide plate 16B is interlocked with the transfer plate 11 such that it is lowered below the top of the block 8 by an interlocking mechanism (not shown) when the transfer groove 12 of the transfer plate 11 is advanced beyond the receiving slit 9 and is raised above the top of the block 8 when the transfer groove 12 is retreated from the receiving slit 9.

Figure 2:
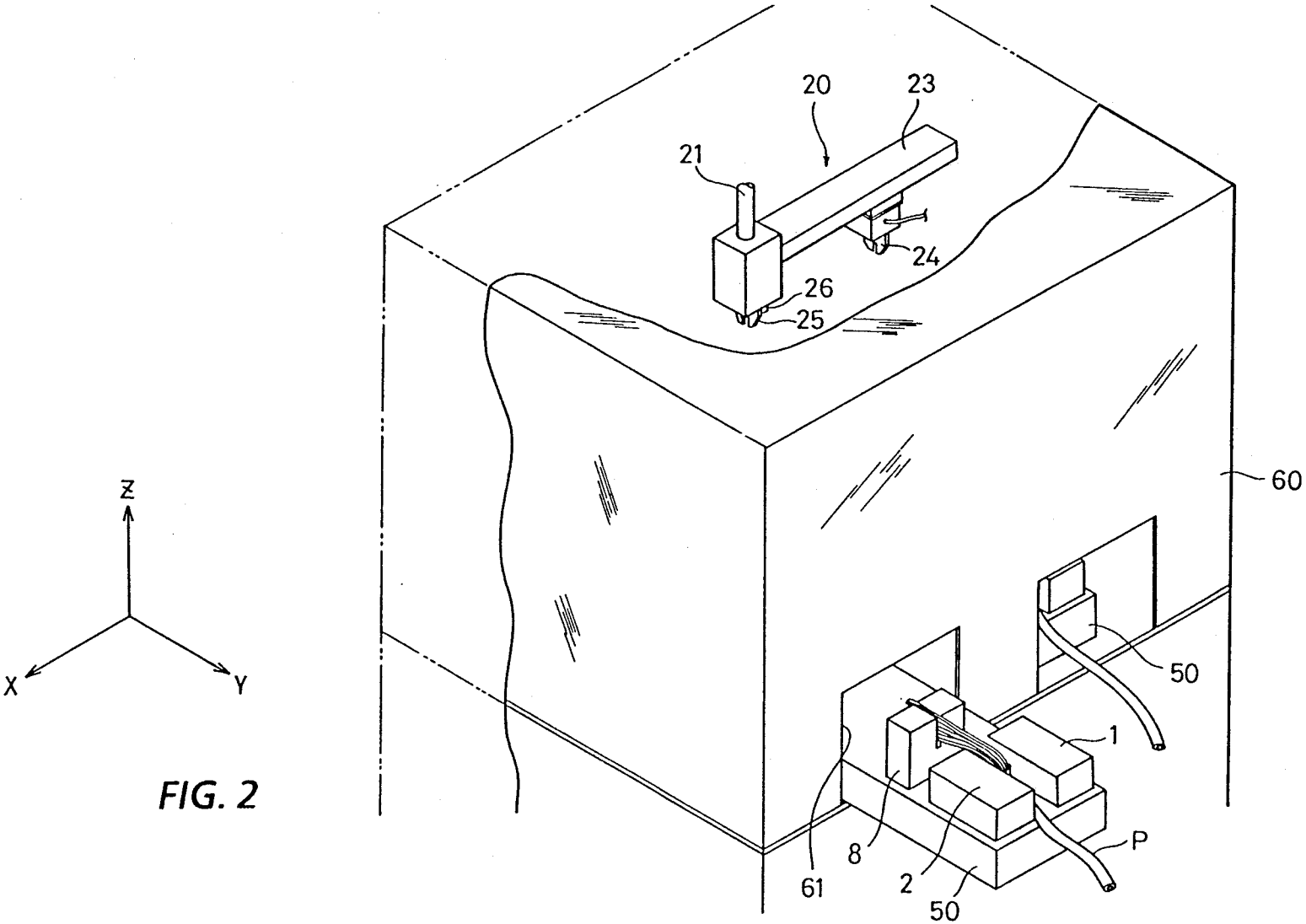
FIG. 2 is a perspective view, partially cut away, of the cable loading machine.

As shown in FIG. 2, the movable base 50, and the base sections 1 and 2, and the receiver block 8 constitute an integral unit, which is movable through the opening 61 of a housing 60 in the Y direction. A number of such units (two units in this embodiment) are placed side by side in the X direction such that they are independently movable under instructions.

A conductor carrier 20 is provided above the base sections 1, 2 for rotation about a shaft 21 extending along the Z axis by a predetermined angle (90 degrees in this embodiment) and three-dimensional movement by a given distance in the rectangular coordinate system. The distance to the retaining channel of a connector is determined by a controller in response to the conductor number identified by a connection detector to be described later.

A carrier arm 23 laterally extends from the carrier frame 22 of the conductor carrier 20. Two pairs of fingers 24 and 25 extend downwardly from the carrier frame 22 and the carrier arm 23 for holding a conductor between them. A pusher 26 is provided adjacent the fingers 25 for reciprocating movement along the Z axis.

Figure 3:
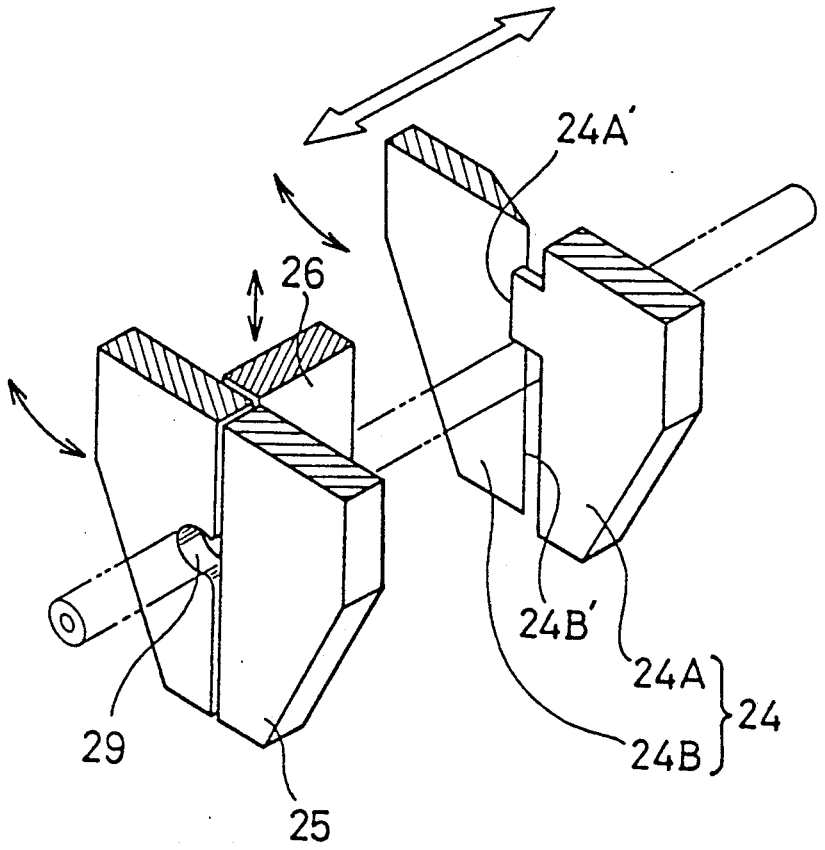
FIG. 3 is a perspective view of fingers for the cable loading machine.

As shown in FIG. 3, the fingers 24 consists of a fixed finger 24A and a movable finger 24B. The fixed finger 24A has a tab 24A' for positioning a conductor. The movable finger 24B' has a blade 24B' which cuts the insulation of a conductor and comes into contact with the core wire for connection detection. As shown in FIG. 1, the blade 24B' is insulated from the carrier arm 23 with an insulator 27 and connected to a connection detector (not shown) via a conductor 28 so that the conductor number is determined. One of the fingers 25 has a semi-circular notch 29 for slidably holding a conductor. The fingers 25 are slidable along the carrier arm 23 with a cylinder (not shown) so that their distance to the other fingers 24 is changed at will.

A method of loading a multiconductor cable on a connector with the above machine will be described.

(1) A desired length of sheath at either end of a multiconductor cable P, which consists of a number of insulted wires W bundled within the sheath, is cut off to separate respective conductors. As shown in FIG. 2, one of the units is drawn from the opening 61. Then, one end of the cable P is held by the cable holder 7 over the sheath. The respective conductors W are inserted in the receiver slit 9. At this point, the transfer plate 11 is held at a retreated position, and the guide plate 16B is raised above the top of the block 8 to form a V-shaped mouth with the guide plate 16A, making it easy to put conductors into the slit 9. When released upon insertion of all of the conductors, the transfer plate 11 is advanced to such an extent that the transfer grooVe 12 registers with the receiver slit 9.

(2) When the unit enters the housing 60 through the opening 61, the biasing plate 10 pushes up the conductors so that only the top conductor is received in the transfer groove 12. The transfer plate 11 is then further advanced in the X direction until the transfer groove 12 reaches the receiving groove 14, and the conductor is held in place.

(3) The two pairs of fingers 24, 25, which are held above the escapement slots 15, are then lowered into the escapement slots 15 to hold the conductor between the fingers. The blade 24B' of the finger 24 cuts the conductor insulator and comes into contact with the core wire to detect the conductor number. Then, the transfer plate 11 is retreated so that the fingers 24, 25 can pick up the conductor.

(4) The fingers 24, 25 are moved upwardly and then laterally in a X-Y plane to a position above the desired channel of a connector block C1 (or C2) while they are spaced further apart from each other to stretch the conductor, so that they are positioned across the connector block C1. Then, the push rod 26 is lowered to a point where it lightly abuts with the top of a conductor. The above positioning is controlled in response to the conductor number identified by the blade 24B'.

(5) The fingers 24, 25 are then lowered by a predetermined distance. Then, the pusher 26 is lowered to insert the conductor into the retaining channel of a connector C1.

(6) The above steps are repeated for each conductor. When all the conductors W are attached to the connector block C1, the connector block is joined to a connector body (not shown) with a number of contacts by means of a press to connect by pressure the conductors to the contacts both mechanically and electrically.

(7) While the unit is loading conductors on the connector as described above in the paragraphs (1) through (6), another unit is drawn from the housing for loading another cable.

(8) Thus, one cable is loaded on a connector block C1 or C2. The above procedure is repeated for other cables for providing finished cables each terminated with connectors at opposite ends.

Alternatively, one or three or more connectors may be connected to a cable. The direction where conductors are inserted into a connector block may be set at a given angle to the direction where the receiver slit receives conductors. The connector block may be replaced with a connector body with a number of contacts to which conductors are directly connected by, for example, insulation displacement techniques.

According to the invention, since a conductor is brought to exactly above the desired retaining channel of a connector block by the fingers and inserted thereinto by the elongated pusher, the operation is very reliable. Also, it is possible to separately load individual conductors to several connectors.

In addition, with the loading machine, it is possible to prepare another cable for another unit while a unit is loading a cable, resulting in the increased operation efficiency. All the loading operations but the preparation for the loading are performed within the housing, thus assuring a safety operation.

I claim:

1. Apparatus for loading a plurality of conductors of a multiconductor cable on a plurality of contacts or retaining channels of a connector, which comprises:

a connector holder for holding said connector such that said contacts or retaining channels are exposed;

a cable holder provided adjacent said connector holder for holding said multiconductor cable beside said connector holder;

receiver means provided adjacent said connector holder, said receiver means including:

a receiver slit extending downwardly from a top surface of said receiver means and having a width substantially equal to a conductor diameter for receiving said conductors aligned one upon another in a vertical plane parallel to said connector holder;

a biasing plate provided at a bottom of said receiver slit for biasing upwardly said aligned conductors;

transfer means provided on said receiver means for reciprocating movement in a direction perpendicular to said vertical plane and having a transfer groove extending parallel to said vertical plane for moving a single top conductor in said receiving slit;

a receiving groove provided on said top surface extending parallel to said vertical plane for receiving a conductor when said transfer means is moved to an advanced position;

an escapement slot extending in a direction perpendicular to said vertical plane and downwardly from said top surface by a distance greater than said conductor diameter;

two pairs of fingers for entering said escapement slot to hold said conductor therebetween when said transfer means is moved to an advanced position, one of said fingers having a blade member which cuts an insulation of said conductor into contact with a core wire;

carrier means with a frame rotatable about a shaft parallel to said vertical plane and movable in each direction of a rectangular coordinate system and having an arm for changing a distance between said two pairs of fingers;

pusher means provided on said carrier means adjacent one of said finger pairs and movable along said shaft to push said conductor into said contact or connection groove of said connector;

a movable base on which said cable holder, said cable receiver means, said carrier means, and said connector holder are mounted as a unit so that they reciprocate along said vertical plane as a unit; and control means in response to a conductor number signal to move said fingers so that said conductor is placed above a desired contact or connection groove and inserted thereinto by said pusher means to thereby load said conductor on said connector.

2. The apparatus of claim 1, wherein said receiver means further includes a pair of guide plates provided on opposite sides of said receiving slit, one of said guide plates being vertically movable such that it is lowered below said top surface of said receiver means when said transfer means is advanced.

3. The apparatus of claim 1, wherein a finger opposed to said finger having said blade is fixed and has tab means for positioning a conductor.

4. The apparatus of claim 1, wherein a finger of the other pair has notch means for slidably holding a conductor.

* * * * *